United States Patent [19]

Rau et al.

[11] 4,043,284

[45] Aug. 23, 1977

[54] BLIND STITCH SEWING MACHINE

[75] Inventors: Winfried Rau, Turkenfeld; Lothar Sommerschuh, Oberschleissheim, both of Germany

[73] Assignee: J. Strobel & Sohne GmbH & Co., Munich, Germany

[21] Appl. No.: 658,757

[22] Filed: Feb. 17, 1976

[30] Foreign Application Priority Data

Mar. 17, 1975 Germany ..... 2511568

[51] Int. Cl.[2] ..... D05B 1/24

[52] U.S. Cl. ..... 112/178; 112/270

[58] Field of Search ..... 112/176, 177, 178, 267, 112/121.11, 218 R

[56] References Cited

U.S. PATENT DOCUMENTS

| | | | |
|---|---|---|---|
| 2,221,148 | 11/1940 | Mueller | 112/176 |
| 2,416,941 | 3/1947 | Mueller | 112/176 |
| 3,611,961 | 10/1971 | Lopez et al. | 112/121.11 |

*Primary Examiner*—George H. Krizmanich

*Attorney, Agent, or Firm*—Stevens, Davis, Miller & Mosher

[57] ABSTRACT

A blind stitch sewing machine is provided on its cloth carrying arm with a fabric feeler or sensor and a rod system which automatically adjusts the depths of penetration of the fabric by the needle. The sensor may be a single arm lever on a rotatably supported shaft. A second lever may be disposed on the shaft for positioning the cloth bender relative to the needle.

32 Claims, 9 Drawing Figures

BLIND STITCH SEWING MACHINE

This invention relates to a blind stitch sewing machine with automatic adjustment of the depth of insertion of the needle corresponding to the thickness of the material being sewed, the fabric bender being displaceable with respect to the needle on the cloth support arm.

Blind stitch sewing machines serve to sew the fabric in such a manner that the stitch is not visible on at least one outer side of the fabric. These sewing machines therefore have a curved needle and at least one cloth bender which bulges the fabric out. This bulge extends through an opening in the needle plate into the path of the needle so that the needle does not pass completely through the two layers of fabric which are to be connected together but merely grazes the outer layer of fabric arranged away from the needle so that the stitch formed remains invisible from the side of the fabric facing away from the needle.

In order to assure the dependable production of such a stitch, the depth of insertion of the needle must be adjusted in accordance with the thickness of the fabric and therefore with the position of the cloth bender up to which the or each cloth bender may approach the curved needle or its path. In this connection particular difficulties exist when the frabic is not of uniform thickness and when, for instance, transverse seams, pockets, and other thicker parts are present.

A large number of proposals have already been made for the manual adjustment of the depth of penetration of the needle corresponding to the specific thickness of the fabric in blind stitch sewing machines. In this connection the cloth carrying arm which is provided with the corresponding cloth bender and is pivotally supported with respect to the upper arm head of the sewing machine and is spring-urged towards the head is simply adjusted by hand with respect to the head or the needle provided thereon (German Provisional Pat. No. 1,012,153 and German Pat. No. 1,051,101, for instance). In this connection special measures have also been taken to be able rapidly to adjust the depth of penetration of the needle when thickened portions are present in the fabric being sewed (German Pat. No. 888,195).

In order to blind stitch automatically only the desired layer of fabric set in each case in blind stitch sewing machines even when sewing over transverse seams, pockets, and other thickened portions in the fabric, it is furthermore known to provide the vertically reciprocating cloth bender with an outwardly spring-urged tip which presses the fabric under spring action against an adjustable stop of the corresponding needle plate. Stop and point of cloth bender and/or the springs thereof can be so adjusted that in the case of thickenings in the fabric which do not correspond to the normal height adjustment of the cloth bender and therefore that position of the cloth bender up to which the cloth bender can approach the sewing needle or its path, the cloth bender point is automatically pressed sufficiently down that the needle penetrates only the desired layer of fabric. However, for different fabrics, particularly as a function of their thickness, softness, etc., manual adjustment is necessary also in the case of this proposal (German Pat. No. 1,102,535).

Finally, it is already known in blind stitch sewing machines to change the height up to which the cloth bender rises, i.e. approaches the needle, by displacing the cloth bender with respect to the fixed cloth carrying arm, which again is effected manually by means of an adjusting knob on the blind stitch sewing machine (German Pat. No. 948,735 and German Unexamined Application for Pat. No. 2,130,434.

It is an object of the present invention to provide a blind stitch sewing machine having means for assuring automatic adjustment of the depth of penetration of the needle in accordance with the specific thickness of the fabric, the fabric being automatically palpated or probed directly with relatively slight pressure so that manual adjustment is unnecessary and the sources of error inherent therein are excluded, whereby there is not only obtained an automatic adaptation to different fabrics but also to different thicknesses of one and the same workpiece upon the sewing thereof. Furthermore too high a pressure of the cloth bender on the fabric is avoided.

A more specific object of the invention is to provide a blind stitch sewing machine with a means for automatically adjusting the depth of needle penetration of a fabric in accordance with variation in fabric characteristics and thickness.

Other objects will become apparent from the following description with reference to the accompanying drawing wherein FIG. 1 is a top view, partially in horizontal section, as seen in the direction of the arrow I in FIG. 2 of the cloth carrying arm of the first embodiment;

Figure 5:
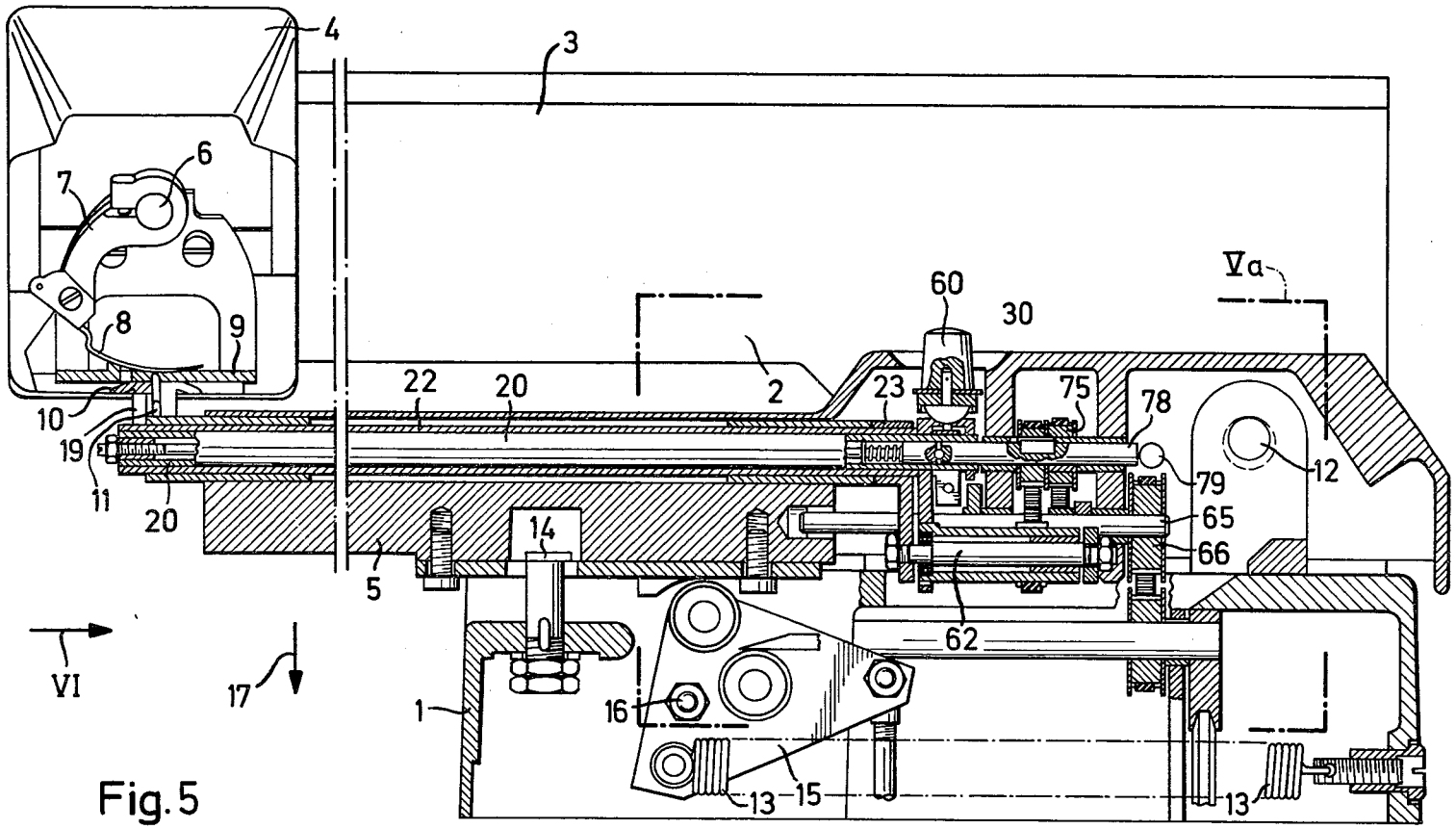
FIG. 5 is a front view of the second embodiment, partially in vertical longitudinal section.
Figure 5A:
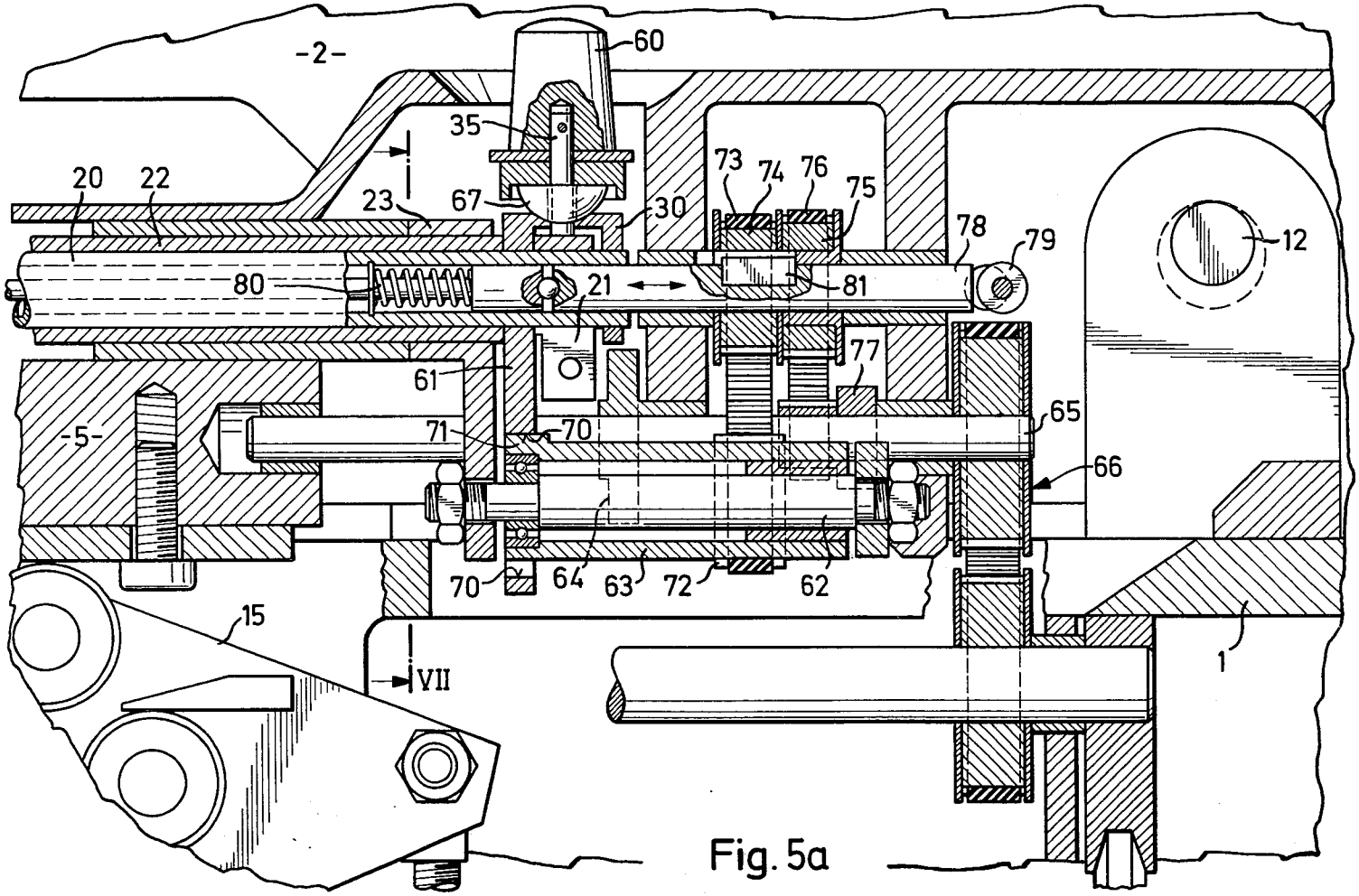
Figure 6:
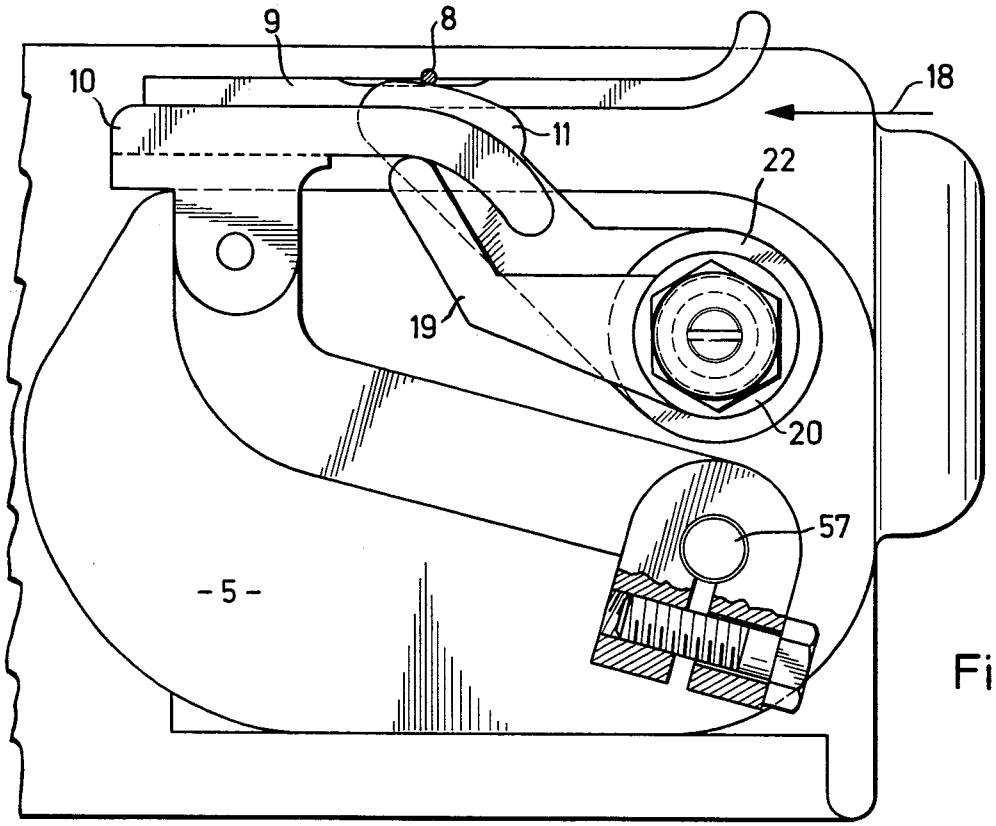
Figure 7:
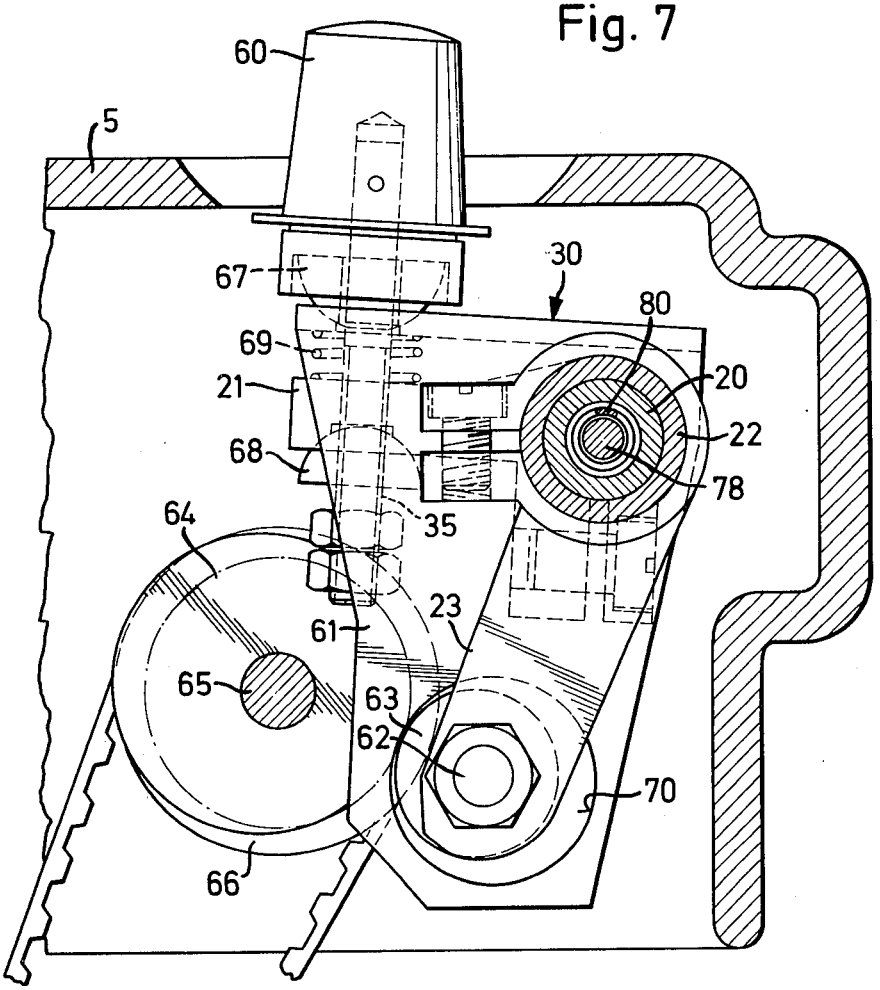
Figure 8:
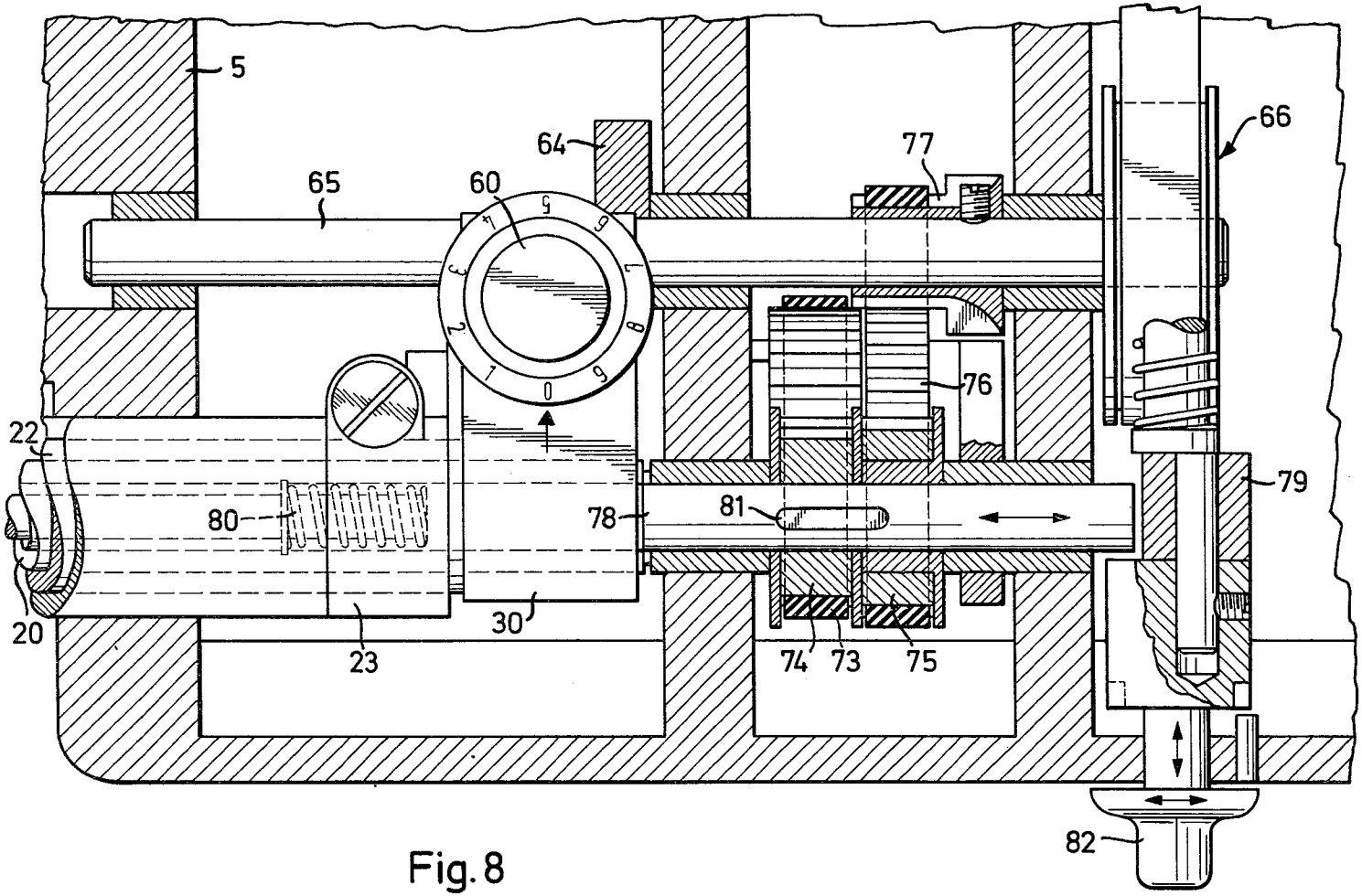

FIG. 5*a* is a portion V*a* of the view according to FIG. 5, shown on a larger scale;

FIG. 6 is a view in the direction of the arrow VI of the cloth carrying arm of the embodiment of FIG. 5, shown on a larger scale;

FIG. 7 ia a vertical cross section along the line VII—VII of FIG. 5*a* through the cloth carrying arm of the embodiment of FIG. 5, shown in the same scale as FIG. 6; and FIG. 8 is a horizontal longitudinal section through the right-hand part (as seen in FIG. 5) of the cloth carrying arm of the embodiment of FIG. 5 which is taken through two different horizontal planes containing the connecting shaft and the drive shaft respectively, shown in the same scale as FIGS. 6 and 7.

The foregoing objects and others are accomplished in accordance with this invention, generally speaking, by providing a blind stitch sewing machine having a cloth bender on the fabric carrying arm which is adjustable with respect to the needle by means of a fabric feeler member and a rod system through which the feeler member cooperates with the fabric or cloth bender to set the highest position of the cloth bender.

Two preferred embodiments of the blind stitch sewing machine of the invention are described by way of example below with reference to the accompanying diagrammatic drawing.

As can be noted with particular clarity from FIG. 5, the blind stitch sewing machine has a hollow base 1, on the side thereof a hollow vertical stand or column 2, a hollow upper arm 3 which has a sewing head 4 on its free end and extends laterally away from the end of the stand 2 facing away from the base 1 and horizontally over the base 1, and a hollow cloth carrying arm 5 arranged substantially parallel to the upper arm 3 and below it. The upper-arm head 4 bears a needle lever 7 which is connected for pivotable reciprocation with a shaft 6 and bears a curved sewing needle 8, and also a needle plate 9. On the adjacent free end of the cloth carrying arm 5 there are provided a cloth presser plate 10 and a cloth bender 11.

The cloth carrying arm 5 is supported on the end facing away from the upper-arm head 4 for pivoting around a horizontal shaft 12, which is disposed transverse to the longitudinal axis of the cloth carrying arm. Cloth carrying arm 5 moves substantially perpendicularly to the longitudinal axis of the upper arm, and is pressed by a tension spring 13 against a stop 14 of the base 1 via a lever 15. Lever 15 is pivotally supported around a shaft 16 parallel to the shaft 12 on the base 1. Lever 15 can be swung in a clockwise direction against the action of the spring 13 in order to move the cloth carrying arm 5 away from the head 4 in the direction of the arrow 17 in order to introduce a new piece of material.

In the drawing the operating position of the cloth carrying arm 5 and the highest position of the cloth bender, at which the upper edge of the cloth bender 11 directly adjoins the path of the curved needle 8 are shown. Needle plate 9 and cloth presser 10 lie directly against each other since no fabric is inserted, except in FIG. 4.

Figure 1:
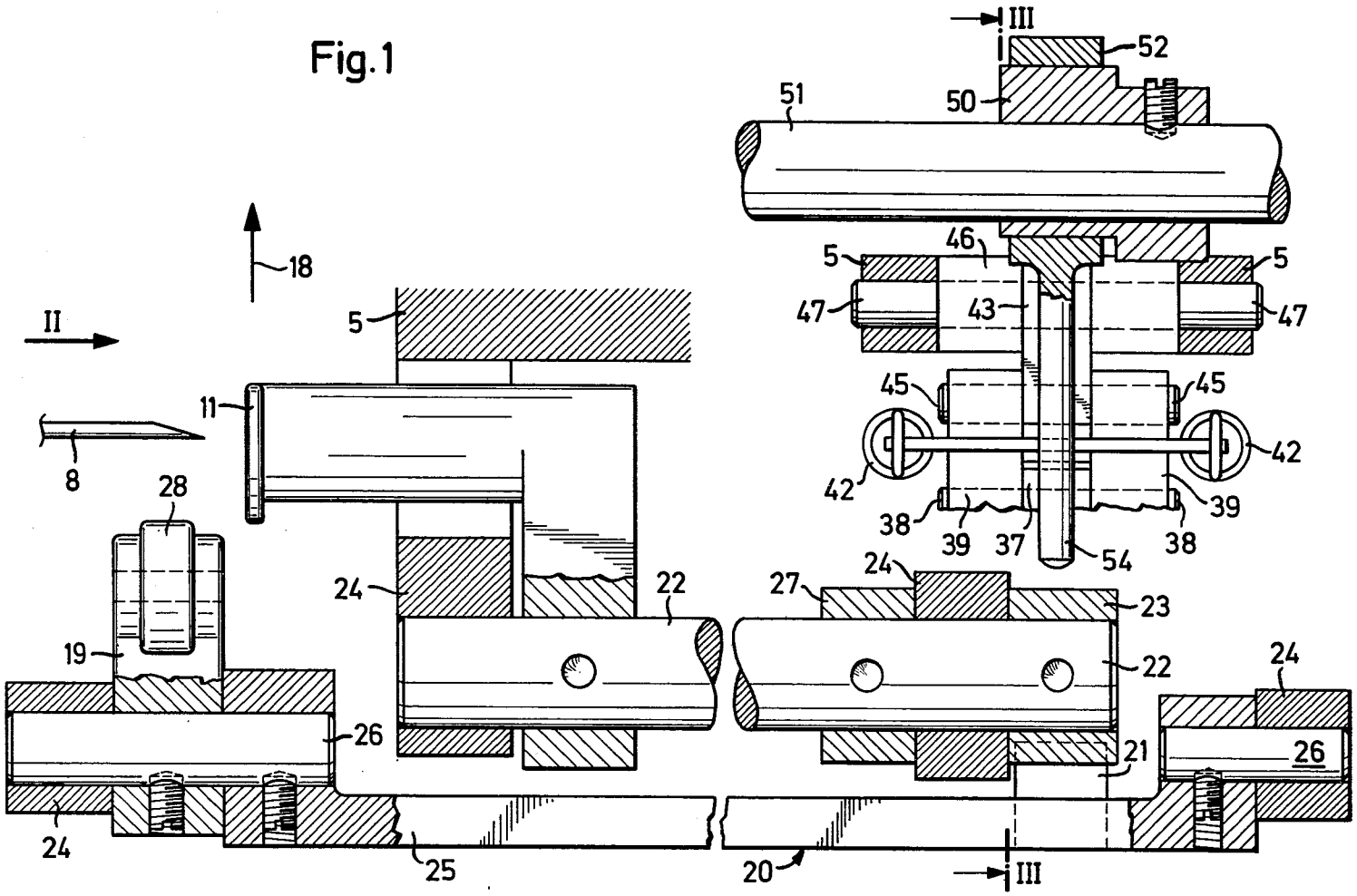
Figure 2:
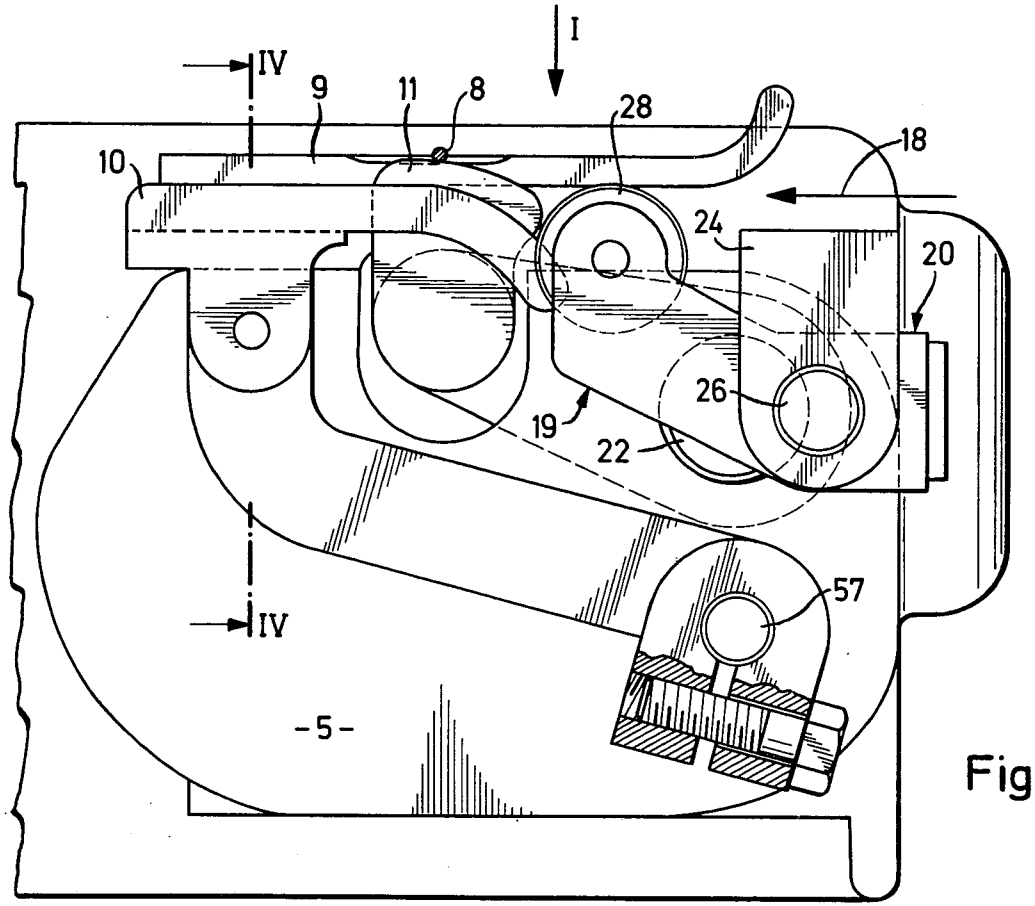
FIG. 2 is an elevation of the cloth carrying arm as seen in the direction of the arrow II in FIG. 1, on a larger scale.

The fabric feed takes place in operation perpendicular to the cloth carrying arm 5 in the direction indicated by the arrow 18 in FIGS. 1, 2, and 6. In this connection the fabric is palpated automatically directly by a feeler member 19 which cooperates via a rod with the cloth bender 11 in order to set the highest position of the cloth bender corresponding to the thickness of the fabric established in the corresponding case. By this highest position of the cloth bender there is to be understood that position of the cloth bender 11 up to which it is capable of approaching the needle 8 or the path thereof.

The feeler member 19 is a single-armed lever and is fastened on a shaft 20 rotatably supported in the cloth carrying arm 5, which shaft has a second one-armed lever 21 for setting the highest position of the cloth bender. The cloth bender is also a one-armed lever 11 which is fastened to a shaft 22 which has a second one-armed lever 23. The lever 23 cooperates with an eccentric means to swing the cloth bender 11 downwardly away from the needle 8 out of the highest position of the cloth bender existing at the time, and furthermore with the lever 21 on the feeler shaft 20 to set the highest position of the cloth bender in accordance with the result of the palpating of the fabric by the feeler 19.

In the embodiment shown in FIGS. 1 to 4, feeler shaft 20 and cloth-bender drive shaft 22 are rotatably supported alongside each other and parallel to the longitudinal axis of the cloth carrying arm in eyes 24 of the cloth carrying arm 5 as can be noted from FIG. 1. The feeler shaft 20 consists of a central yoke 25 and two end pins 26 firmly clamped thereto. On the end pin 26 shown to the left of FIG. 1 there is firmly clamped the single-armed lever or feeler member 19. The feeler shaft 20 is fixed axially between the two corresponding eyes 24 in which the end pins 26 are received. For the axial fixing of the continuously cylindrical cloth-bender drive shaft 22 a ring 27 is clamped on the shaft, the ring together with the adjacent lever 23 surrounding a bearing lug 24.

A feeler member 19 is provided with a roller 28 on its free end. As can be noted from FIG. 1 and with particular clarity from FIG. 2, the roller 28 is arranged approximately one stitch length in fron of the cloth bender 11 in the direction of advance 18 of the fabric and thus feels the corresponding fabric in the region into which the needle 8 penetrates upon the next stitch.

Figure 3:
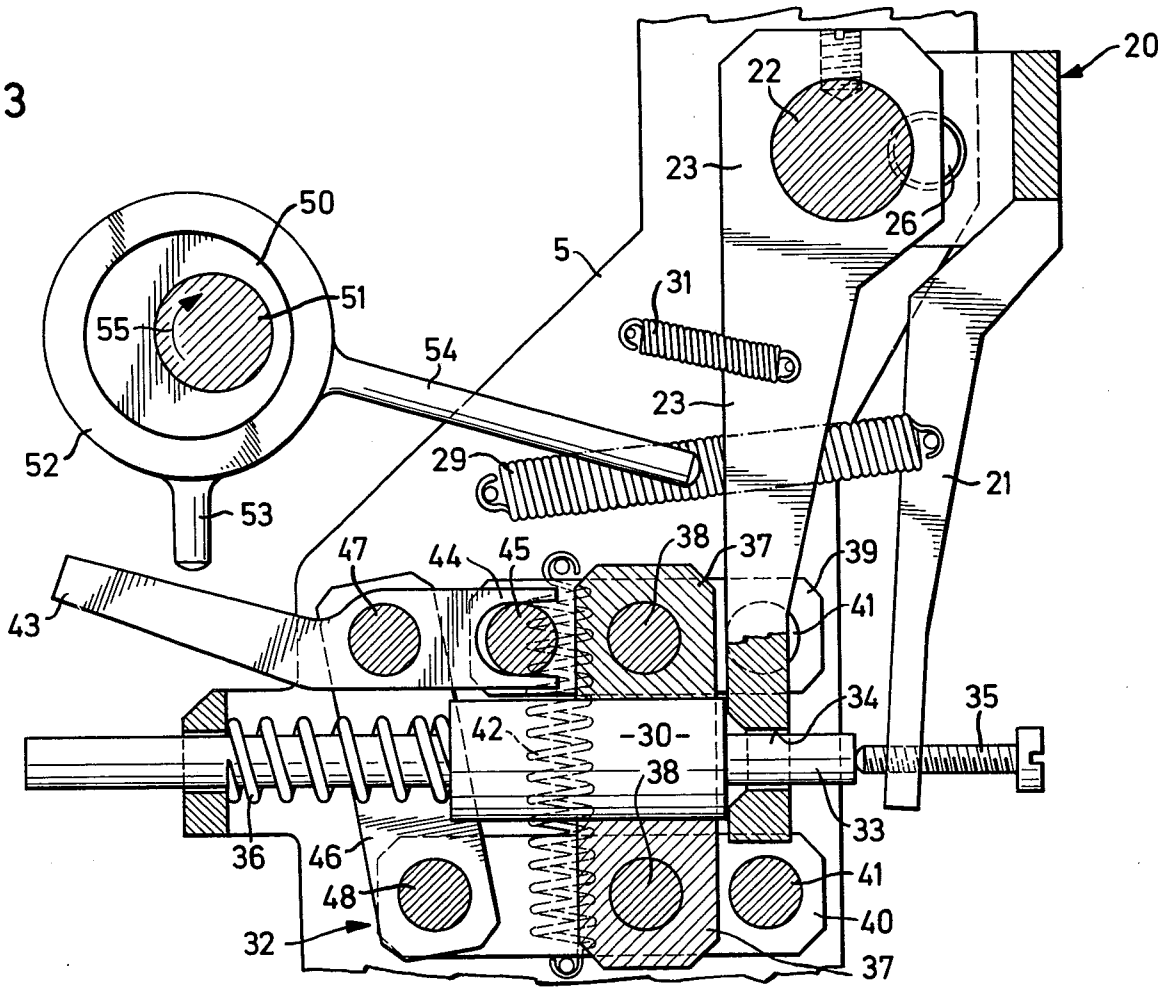
FIG. 3 is a vertical section along the line III—III in FIG. 1 through the cloth carrying arm shown in the same scale as in FIG. 2.

From FIG. 3 it can be noted that the second one-armed lever 21 of the feeler shaft 20 is pressed by means of a tension spring 29 against a stop 30, the second one-armed lever 23 being pressed against it by a tension spring 31. The stop 30 is adjustable by means of the lever 21 in order to adjust the highest position of the cloth bender.

In accordance with FIG. 3 the stop is developed as an axially displaceable bolt 30 which extends through a double shoe brake 32. The bolt 30 has at its end an extension 33 of reduced diameter which extends through a bore hole 34 in the second one-armed lever 23 of the cloth-bender drive shaft 22, the second one-armed lever 21 of the feeler shaft 20 resisting via an adjustment screw 35 against its end, the adjusting screw being adapted to be screwed in the free end of the lever 21.

The stop or bolt 30 is urged by a compression spring 36 at the end facing away from the extension 33 against the action of the springs 29 and 31 acting via the levers 21 and 23. The double shoe brake 32 holds it in the axial position established in each case by the lever 21. The double shoe brake 32 has two brake shoes 37 which are arranged in each case by means of a pin 38 between an upper shorter pair of swing levers 39 and a lower longer pair of swing levers 40. The two pairs of swing levers 39 and 40 are connected at the end adjacent the levers 21 and 23 swingably around a shaft 41 with the cloth carrying arm 5 and are pressed towards each other by two lateral tension springs 42, i.e. with the brake jaws 37 against the stop or bolt 30. They extend in this connection substantially horizontally and parallel to each other as well as to the stop or bolt 30.

There is also provided a two-armed actuating lever 43 whose fork-shaped end 44 surrounds a transverse pin 45 of the upper pair of swing levers 39 and is connected via a connecting strap 46 being pivoted swingably about the pins 47 and 48 respectively on the double-armed actuating lever 43 and the lower pair of swing levers 40, respectively. The actuating lever 43 is swingably supported around the pin 47 on the cloth carrier arm 5. If the double-armed lever 43 is swung in counterclockwise direction out of the position shown in FIG. 3, this causes the upper brake jaw 37 to lift off from the stop or bolt 30 and release the latter.

For this lever actuation an eccentric or cam 50 is provided on a shaft 51 which is rotatably supported in the cloth carrying arm 5. On the eccentric there is seated a ring 52 having a shorter pin 53 and a longer pin 54. The pin 53 cooperates with the end of the actuating lever 43 facing away from the fork 44 while the pin 54 cooperates with the lever 23 of the cloth-bender drive shaft 22.

In operation the feeler 19, by means of its roller 28, senses (feels) the fabric for about one stitch length in front of the needle 8 or the cloth bender 11. It swings downwardly out of the position shown in FIG. 2 by an amount corresponding to the thickness of the specific fabric so that the lever 21 also turns in counter clockwise direction out of the position shown in FIG. 3 against the action of the spring 29. With the shaft 51 rotating in the direction indicated by the arrow 55, the eccentric 50 first of all via the pin 54 presses the lever 23 away from the stop or bolt 30 in opposition to the action of the spring 31 and then via the pin 53 swings the actuating lever 43 in counterclockwise direction and releases the double jaw brake 32, the lever 23 remaining spaced from the stop or bolt 30. The spring 36 then presses the stop or bolt 30 to the right in FIG. 3 until the extension 33 comes to rest against the adjusting screw 35 whereupon the double jaw brake 32 closes again. The lever 23 is brought by the spring 31 against the stop or bolt 30 which is held fast by the double jaw brake 32. The cloth bender 11 now assumes the highest position with respect to the needle 8 which corresponds to the thickness of fabric felt.

The adjusting screw 35 makes it possible to fix the basic position as shown in the drawing, in which connection therefore, in accordance with FIG. 2, the upper edge of the cloth bender 11 adjoins the needle 8 or its path when the roller 28 of the feeler member 19 rests against the needle plate 9. Furthermore, the adjusting screw 35 makes it possible to change the mutual position of feeler member 19 and cloth bending member 11 in order to select in advance the desired depth of penetration of the needle so that, for instance, only one or several layers of fabric are penetrated by the needle, blind-stitching or through-stitching is effected, etc.

Therefore there is obtained an automatic adaptation of the corresponding depth of penetration of the needle to the specific thickness of fabric this being done in simple and rapid as well as dependable manner, the thickness of the fabric being gauged ("felt") in a very sensitive manner with extremely little pressure which may be considerably less than the required operating pressure on the cloth bender.

Figure 4:
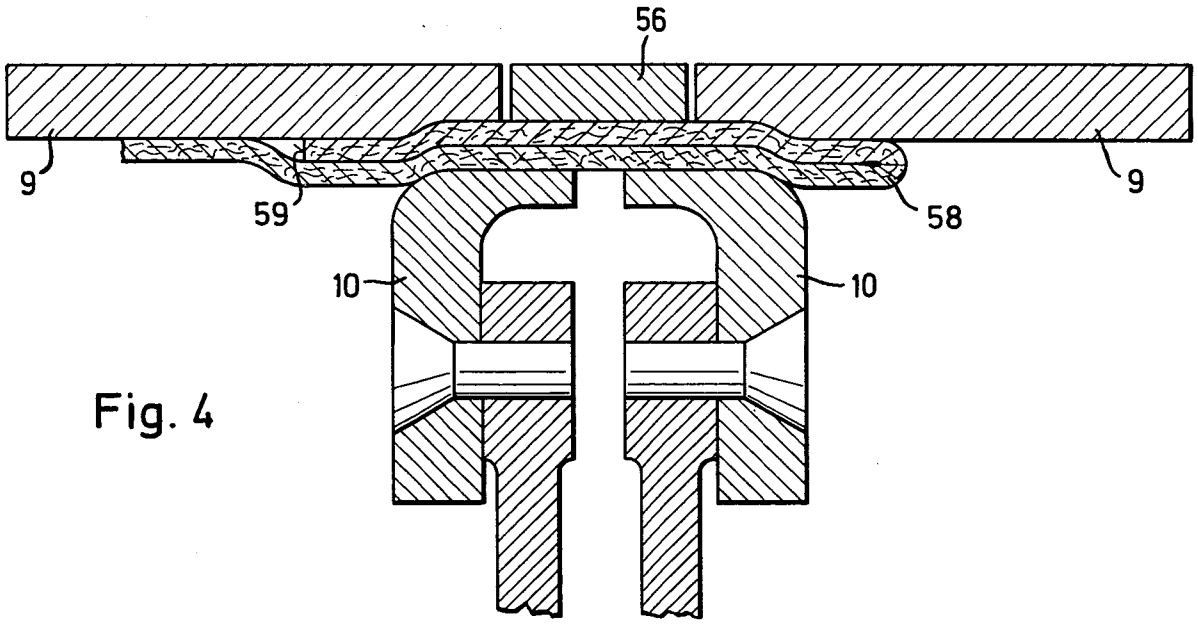
FIG. 4 is a vertical section along the line IV—IV of FIG. 2.

From FIG. 4 there can be noted the mutual arrangement of needle plate 9 with a feed dog 56 and presser plate 10 which in accordance with FIG. 2 is supported for swinging around a shaft 57 on the cloth carrier arm 5 and is adapted to be urged by a spring (not shown) towards the needle plate 9 in order to press the fabric 58 shown in FIG. 4 against the needle plate 9 and the feed dog 56.

The embodiment shown in FIGS. 5 to 8 differs essentially from the embodiment of FIGS. 1 to 6 by the fact that there is no brake 32 and that the feeler 19 directly displaces the stop 30 which determines the highest position of the cloth bender. The stop 30 is therefore connected with the system of rods of the feeler 19, i.e. with the lever 21 of the shaft 20 which bears the feeler 19 so that every movement of the feeler 19 is transmitted immediately directly to the stop 30. Feeler 19 and stop 30 therefore move simultaneously.

Also differing from the embodiment in accordance with FIGS. 1 to 4, in the embodiment of FIGS. 5 to 8 the fabric thickness is gauged (felt) directly parallel to the needle insertion and not a stitch length in front of it. For this purpose the feeler 19 is arranged below the cloth presser plate 10 resting via same against the fabric, as can be noted clearly from FIGS. 5 and 6. Instead of this the feeler 19 however can also be arranged laterally of the needle penetration and rest directly on the fabric. This palpating (feeling) of the fabric laterally of the needle penetration point and in which connection therefore the feeler 19, contrary to the showing of FIG. 5, is displaced towards the left and extends alongside the presser plate 10, may then be necessary and is preferred in the event that, in accordance with FIG. 4, no seam is formed directly at the edge 59 of the fabric and thus the pressure plate 10 or the left part thereof in FIG. 4 not only rests against a layer of fabric but the seam is formed at a certain distance from the edge 59 of the fabric and only one layer of fabric is to be sensed (felt), namely the lower layer of fabric in FIG. 4.

In the embodiment in accordance with FIGS. 5 to 8, the cloth-bender drive shaft 22 bearing the cloth bender 11 and the feeler shaft 20 bearing the feeler 19 are arranged coaxially to each other in the cloth carrying arm 5, the continuously cylindrical hollow feeler shaft 20 being rotatably supported in the hollow cloth-bender drive shaft 22 and the latter being supported in the cloth carrying arm 5.

The feeler shaft 20, at the end facing away from the feeler 19, has the second single-armed lever 21 which is clamped fast on the shaft 20. The lever 21 is surrounded by the box-shaped stop 30 which is rotatably supported on the feeler shaft 20. The stop 30 and lever 21 are connected together by an adjusting screw 35 with rotary knob 60.

As can also be clearly noted from FIG. 5, 5*a* the cloth-bender drive shaft 22 is provided on the end facing away from the cloth bender 11 with the second single-armed lever 23. This lever 23 is arranged directly in front of the stop 30 and the latter has its longer arm 61 directly in front of the single-armed lever 21 of the feeler shaft 20. The lever 23 of the cloth-bender drive shaft 22 has an extension parallel thereto which consists of a shaft 62 fastened to the lever 23 and a sleeve 63 rotatably supported thereon. This extension cooperates with an eccentric 64 for the cloth-bender drive and furthermore with the stop 30 and its arm 61.

The eccentric 64 is keyed onto a drive shaft 65 which is rotatably supported in the cloth carrying arm 5 and is driven via a toothed-belt drive 66 in the customary manner by an electric motor, not shown. By the extension of the lever 23 of the cloth-bender drive shaft 22 which extension is spring-urged against the eccentric 64 and lies with the sleeve 63 on the periphery of the eccentric, the eccentric 64 produces a backward and forward swinging motion of the cloth bender 11 which therefore, upon each rotation of the eccentric 64 is swung once out of the highest position of the cloth bender shown in FIGS. 4, 5, and 6 downwardly away from the needle 8 and then is moved again upwardly into this position.

From FIG. 7 there can be particularly clearly noted the connection between the box-shaped stop 30 and the lever 21 of the feeler shaft 20 by means of the adjusting screw 35. The adjusting screw has a knob 60 and below it a semi-spherical pressure piece 67 as well as a nut 68 which is also semi-spherical. The pressure piece 67 rests on top against the stop 30, and the nut 68 on the bottom against the lever 21. Between the latter and the stop 30 there is a compression spring 69. If the knob 60 is turned in one direction or the other then the pressure piece 67 and the nut 68, which in each case form an abutment on the adjusting screw 35 move to or away from each other so that the stop 30 swings with respect to the lever 21 on the feeler shaft 20, i.e. it turns to the right or to the left from the position shown in FIG. 7.

As can also be noted from FIG. 7, the extension of the lever 23 of the cloth-bender drive shaft 22 which consists of shaft 62 and sleeve 63 extends through a recess 70 in the arm 61 of the stop 30. This recess 70 is so dimensioned that it does not prevent the swinging motion of the lever 23 or of the extension thereof to the right in FIG. 7 as the eccentric 64 rotates.

In FIGS. 5 to 7 there is shown the position of cloth bender 11 and feeler 19 as well as of the parts connected therewith in which the feeler 19 or pressure plate 10 against which the feeler 19 rests is pressed directly against the needle plate 9 while the upper edge of the cloth bender 11 adjoins the needle 8 or its path. From this highest position, the cloth bender 11 is swung downwardly away from the needle 8 upon a revolution of the eccentric 64 and then moves back again into this highest position of the cloth bender. If fabric is between the needle plate 9 and the pressure plate 10 then the feeler 19 swings downward in FIGS. 5 and 6 corresponding to the thickness of the fabric so that the lever 21 of the feeler shaft 20 and the stop 30 connected therewith turn out of the position shown in FIG. 7 correspondingly in counterclockwise direction. This has the result that the extension of shaft 62 and sleeve 63 of lever 23 of the cloth-bender drive shaft 22 is moved correspondingly far away from the drive shaft 65 so that this extension therefore no longer rests on the periphery of the eccentric 64 in the turned position of the eccentric shown in FIG. 7. The cloth bender 11 is correspondingly swung downwardly, i.e. away from the needle 8 out of the position shown in FIGS. 5 and 6 so that upon rotation of the eccentric 64 the cloth bender 11 is moved downwardly away from this new highest position of the cloth bender and then back upwardly again.

The feeler 19 probes the thickness of the fabric over the pressure plate 10 directly at the place of insertion of the needle 8 in order, via the mechanical rod system described, immediately to set the highest position of the cloth bender corresponding to the thickness of fabric found. The cloth bender 11 swings downwardly in each case after the puncturing has been effected and the taking up of the loop, driven by the eccentric 64, in the manner described. It thus releases the fabric for the further advance and before the next insertion of the needle 8 into the fabric swings upwardly until the extension of the lever 23 of the cloth-bender drive shaft 22 comes to rest at the recess 70 in the arm 61 of the stop 30.

The adjusting screw 35 in addition to the automatic probing (feeling) of the fabric makes possible a fine adjustment, particularly also with consideration of the fact that the materials to be worked on blind stitch sewing machines are of different hardness or softness. Fine adjustments of the order of magnitude of for instance 2/100 mm can be effected.

The fabric lying below the needle 8 in the blind stitch sewing machine can therefore be probed (felt) directly and very accurately in order to determine the thickness of fabric.

In the embodiment in accordance with FIGS. 5 to 8 additional measures are taken in order to make interval operation possible. For this purpose an additional control of the stop 30 is provided in the manner that the cloth bender 11 after a given number of stitches is moved upwardly less, i.e. towards the needle 8 by a given amount. For example, the cloth bender 11 can be moved one layer of fabric less upwardly towards the needle 8 upon every second or third stitch.

For this purpose the extension of the lever 23 of the cloth-bender drive shaft 22 is provided with a rotatably supported eccentric 71 which cooperates with the stop 30. This eccentric 71 is developed on the sleeve 63 and extends into the recess 70 of the arm 61 of the stop 30.

The sleeve 63 is furthermore provided with a gear 72 around which there is wrapped a toothed-belt 73 which surrounds another gear 74. Adjacent to gear 74 there is provided a further gear 75 which is connected by a toothed-belt 76 with a gear 77 on the drive shaft 65.

The eccentric 71 can be optionally coupled with or disconnected from the drive shaft 65 in the manner that the gears 74 and 75 are connected with or disconnected from each other. For this purpose there is provided in the hollow feeler shaft 20 an axially displaceable coupling shaft 78 which is movable axially between two positions by means of a rotatable eccentric 79 against which the end of the coupling shaft 78 facing away from the feeler shaft 20 is pressed by a spring 80.

The coupling shaft 78 has a parallel key 81 which connects the gear 74 for rotation with the coupling shaft 78 and can be brought into engagement with the gear 75 in order to connect the latter also fast for rotation with the coupling shaft 78. In FIGS. 5, 5*a* and 8 there is shown the axial position of the coupling shaft 78 in which the two gears 74 and 75 are connected by the parallel key 81 with the coupling shaft 78 and the rotation of the drive shaft 65 is thus transmitted to the sleeve 63 and its eccentric 71, the coupling shaft 78 rotating with the gears 74 and 75 at least in the region thereof. By turning the eccentric 79 by means of an outer knob 82 by 180° the coupling shaft 78 is brought from the right-hand axial end position (as seen in FIGS. 5, 5*a* and 8) described, against the action of the spring 80 into the left-hand axial end position, not shown, so that the parallel key 81 comes out of engagement with the gear 75 and the drive of the sleeve 63 thus of the eccentric 71 is interrupted.

The rotating eccentric 71 causes the extension of the lever 23 of the cloth-bender drive shaft 22 to come to rest independently of the instantaneous position of the stop 30 later or sooner against the recess 70 of the stop arm 61 and the cloth bender 11 thus comes closer or farther from the needle 8 and its path.

Although the invention is described in detail for the purpose of illustration, it is to be understood that such detail is solely for that purpose and that variations can be made therein by those skilled in the art without departing from the spirit and scope of the invention except as it may be limited by the claims.

What we claim is:

1. In a blind stitch sewing machine having a needle and a cloth carrying arm comprising a cloth bending means adjustable with respect to the needle, means for automatically adjusting the depth of penetration of the cloth by the needle by positioning the cloth bending means comprising a fabric feeler and a rod system through which the feeler cooperates with the cloth bender to set the highest position of the cloth bender.

2. A blind stitch sewing machine according to claim 1, wherein the cloth bending means comprises a cloth-bender drive shaft and a stop for said drive shaft in the highest position of the cloth bender, whih stop is adjustable by the rod system.

3. A blind stitch sewing machine according to claim 2 wherein the mutual position of feeler and cloth bender is variable.

4. A blind stitch sewing machine according to claim 3 wherein an adjusting screw is provided between the rod system and the stop.

5. A blind stitch sewing machine according to claim 1 wherein the feeler is a single-armed lever on a rotatably supported shaft which has a second single-armed lever for setting the highest position of the cloth bender.

6. A blind stitch sewing machine according to claim 5 wherein the feeler shaft is rotatably supported in the cloth carrying arm.

7. A blind stitch sewing machine according to claim 1 wherein the cloth bender is a single-armed lever on the cloth-bender drive shaft which has a second single-armed lever cooperating with a rotating eccentric.

8. A blind stitch sewing machine according to claim 7 wherein there is provided a stop for the cloth-bender drive shaft, and wherein the second single-armed lever on the cloth-bender drive shaft is urged by spring action against the stop.

9. A blind stitch sewing machine according to claim 7 wherein the feeler is mounted on a feeler shaft rotatably supported on the cloth carrying arm and the cloth-bender drive shaft is rotatably supported in the cloth carrying arm and is arranged parallel to the feeler shaft.

10. A blind stitch sewing machine according to claim 1 wherein the feeler is provided on its free end with a roller.

11. A blind stitch sewing machine according to claim 2 wherein the feeler is arranged whereby the feeler senses the cloth thickness at a distance in front of the cloth bender in the direction of the cloth movement, the stop is spring loaded towards the rod system and clamped fast by a brake, and an eccentric is provided to open the brake and to release the stop.

12. A blind stitch sewing machine according to claim 11 wherein the stop is an axially displaceable bolt which extends through the brake.

13. A blind stitch sewing machine according to claim 12 wherein the said brake comprises a double shoe brake, each of the two brake shoes of which is arranged on one of two pairs of swing levers which are parallel to each other and are urged by springs against each other, on the ends of which facing away from the corresponding swing shaft a double-armed actuating lever acts directly with its one end or at a distance from said end via a connecting strap, said actuating lever being actuatable on the other end by the eccentric for opening the brake.

14. A blind stitch sewing machine according to claim 12 wherein the bolt has an extension of reduced diameter which extends through a bore hole in the second single-armed lever of the cloth-bender driver shaft and the second single-armed lever of the feeler shaft rests against the front side of the extension.

15. A blind stitch sewing machine according to claim 14 wherein the second single-armed lever of the feeler shaft is provided on the free end with an adjusting screw which rests against the extension.

16. A blind stitch sewing machine according to claim 14 wherein the two single-armed levers are urged by spring action towards the bolt which is urged in opposite direction by the corresponding spring.

17. A blind stitch sewing machine according to claim 11 wherein the opening eccentric of the brake is arranged whereby the stop is released by the brake in order to set the highest position of the cloth bender before the cloth bender carries out an operating stroke.

18. A blind stitch sewing machine according to claim 2 wherein the feeler and cloth-bender are arranged side by side and the stop is connected with the rod system.

19. A blind stitch sewing machine according to claim 18 wherein the cloth-bender drive shaft and a shaft carrying the feeler are arranged coaxially to each other.

20. A blind stitch sewing machine according to claim 19 wherein the feeler shaft is rotatably supported in the hollow cloth-bender drive shaft.

21. A blind stitch sewing machine according to claim 20 wherein the stop is rotatably supported on the feeler shaft and surrounds the second single-armed lever of the feeler shaft, and that the stop is turnable with respect to the lever by means of an adjusting screw.

22. A blind stitch sewing machine according to claim 21 wherein the stop and lever are urged by spring action away from each other against abutments of the adjusting screw which are displaceable with respect to each other.

23. A blind stitch sewing machine according to claim 21 wherein the second single-armed lever of the cloth-bender drive shaft, the single-armed lever of the feeler shaft, and the stop are arranged one behind the other.

24. A blind stitch sewing machine according to claim 23 wherein the lever of the cloth-drive shaft has an extension which is parallel to said cloth-drive shaft and is received in a recess of the stop.

25. A blind stitch sewing machine according to claim 24 wherein the extension cooperates with an eccentric for the cloth-bender drive.

26. A blind stitch sewing machine according to claim 18 provided with an additional control means for the stop whereby the cloth bender after a given number of stitches in each case moves upward by a distance which is smaller by a given amount.

27. A blind stitch sewing machine according to claim 26 wherein the cloth-bender drive shaft is provided with a single-armed lever having an extension which is parallel to said cloth-bender drive shaft and is received in a recess of the stop, said extension cooperating with an eccentric for the cloth-bender drive and being provided with a rotatably supported eccentric which cooperates with a stop and extends into said recess of the stop.

28. A blind stitch sewing machine according to claim 27 wherein the eccentric can be alternatively connected to and disconnected from a drive shaft.

29. A blind stitch sewing machine according to claim 28 comprising a coupling shaft which is axially displaceable in the hollow feeler shaft and is movable between two positions in which two gears arranged on the coupling shaft are connected with or disconnected from each other, said gears being connected in each case via a toothed-belt with the eccentric or with the drive shaft.

30. A blind stitch sewing machine according to claim 28 wherein the drive shaft bears the eccentric for the cloth-bender drive.

31. A blind stitch sewing machine according to claim 29 wherein the coupling shaft is axially displaceable by means of a turnable eccentric against which the end of the coupling shaft facing away from the feeler shaft is pressed by spring action.

32. In a blind stitch sewing machine having a needle, a needle plate and a fabric carrying arm disposed below the needle plate, the improved means for adjusting the depth of penetration of the fabric by the needle which comprises means associated with the fabric carrying arm for sensing the thickness of the fabric, means for bending the fabric, and means responsive to the sensing means for positioning the bending means with respect to the needle.

* * * * *